US005951318A

United States Patent [19]

Harada

[11] Patent Number: 5,951,318

[45] Date of Patent: Sep. 14, 1999

[54] BULB SOCKET

[75] Inventor: Tadashi Harada, Shimizu, Japan

[73] Assignee: Koito Manufacturing Co., Ltd., Tokyo, Japan

[21] Appl. No.: 08/878,773

[22] Filed: Jun. 19, 1997

[51] Int. Cl.[6] ..... H01R 33/09

[52] U.S. Cl. ..... 439/356; 439/699.2

[58] Field of Search ..... 439/350–356, 439/548, 556–558, 699.2

[56] References Cited

U.S. PATENT DOCUMENTS

| | | | |
|---|---|---|---|
| 4,752,241 | 6/1988 | Matsuoka et al. | 439/619 |
| 4,871,331 | 10/1989 | Kondo et al. | 439/736 |
| 4,940,422 | 7/1990 | Forish et al. | 439/356 |
| 4,957,455 | 9/1990 | Horiuchi et al. | 439/548 |
| 5,008,588 | 4/1991 | Nakahara | 439/699.2 |
| 5,078,625 | 1/1992 | Anzai | 439/356 |
| 5,120,233 | 6/1992 | Mikola | 439/356 |

*Primary Examiner*—Hien Vu

*Attorney, Agent, or Firm*—Sughrue, Mion, Zinn Macpeak & Seas, PLLC

[57] ABSTRACT

The bulb sockets including a socket main body (10) formed of synthetic resin and having a bulb insertion opening (12) which is opened forwardly and into which a wedge base bulb (50) can be inserted. On the outside surface of the socket main body (10), there are provided securing projections (20) which can be respectively engaged with a socket mounting hole (62) formed in a socket mounting member (60) to thereby restrain the socket main body (10) against removal, and a flange (30) cooperarable with the securing projections (20) in holding the peripheral edge portion of the socket mounting hole (62) between them. Within the bulb insertion opening (12), elastic hooks (13) for holding the outside surface of a flat base (52) of a bulb (50) inserted into the bulb insertion opening (12) to thereby prevent the flat base (52) against removal are arranged in parallel along the forming walls (11*a*) of the bulb insertion opening (12). Inside the bulb insertion opening forming walls (11*a*), there are provided vertical ribs (18) between the parallel disposed elastic hooks (13) and (13), thereby preventing the base (52) of the bulb (50) from being pushed into between the mutually adjoining elastic hooks (13) and (13) and the adjacent side wall.

3 Claims, 13 Drawing Sheets

BULB SOCKET

BACKGROUND OF THE INVENTION

1. Field of the Invention

The present invention relates to a bulb socket and, more particularly, to a socket for a wedge base bulb (no-cap bulb) for use in a lighting device which is employed in an automobile or the like.

2. Related Art

FIG. 13 shows a conventional bulb socket for a wedge base bulb. The conventional bulb socket comprises a socket main body 2 which is formed of synthetic resin and includes a forwardly opening bulb insertion opening 3 into which a wedge base bulb 8 can be inserted. A pair of elastic hooks 4 are provided in the insertion opening for retaining a synthetic resin base 8*a* of the inserted wedge base bulb 8. That is, by inserting the wedge base bulb 8 into the bulb insertion opening 3 from above, or by pulling the wedge base bulb 8 upwardly out of the bulb insertion opening 3, the bulb 8 can be mounted into or removed from the bulb socket by means of the flexibility of the elastic hooks 4.

Also, in the bulb insertion opening 3, there is stored a contact terminal (not shown) which is electrically connected to a plurality of energizing wires 5. In a state where the base 8*a* is engaged with the elastic hooks 4 so that the wedge base bulb 8 is secured in the bulb insertion opening 3, the base 8*a* of the bulb 8 is held between contact terminals provided within the socket main body 2, so that a lead wire 9 exposed to the base 8*a* can be electrically contacted with the contact terminals within the socket main body 2.

Further, on the outer periphery of the socket main body 2, there are provided a plurality of securing projections 6 which can be engaged in a bayonet-like manner in a socket mounting hole formed in a lamp body serving as a lighting device forming member, and a flange 7 which cooperates with the securing projections 6. Thus, if the securing projections 6 are matched to the socket mounting hole and the socket main body 2 is pushed in and, at the same time, if the thus pushed-in socket main body is rotated a given amount along the peripheral edge portion of the mounting hole, then the peripheral edge portion of the mounting hole can be held and fixed by the securing projections 6 and flange 7.

However, in the above-mentioned conventional bulb socket, in order to positively retain the flat outside surface of the base 8*a*, the elastic hooks 4 are arranged in parallel along a wide bulb insertion opening forming wall 2*a*. Due to this, there is produced a certain clearance between the parallel arranged elastic hooks 4 and the adjacent wall 2*a*. As a result of this, when the bulb 8 is inserted into the bulb insertion opening 3, the leading end portion of the base 8*a* can be inadvertently inserted into this clearance. As a result, it is difficult to insert the bulb 8 into the bulb insertion opening 3 smoothly, or if the bulb 8 is pushed in forcibly, there is a possibility that the elastic hooks 4 may be broken.

SUMMARY OF THE INVENTION

The present invention aims at eliminating the drawbacks found in the above-mentioned conventional bulb socket. Accordingly, it is an object of the invention to provide a bulb socket which makes it possible to insert a bulb smoothly into the bulb socket.

In attaining the above object, according to a bulb socket of the present invention, there is provided a bulb socket comprising, on the outside surface of a synthetic resin socket main body including a bulb insertion opening opened forwardly for insertion of a wedge base bulb thereinto, a plurality of securing projections engageable in a bayonet-like manner with a socket mounting hole formed in a bulb mounting member to thereby prevent the socket main body against removal, and a flange cooperable with the securing projections for holding the peripheral edge portion of the socket mounting hole between them, wherein, within the bulb insertion opening, a plurality of elastic hooks, for holding the outside surface of a flat base of the bulb inserted into the bulb insertion opening to thereby prevent the bulb against removal, are disposed in parallel along the forming walls of the bulb insertion opening and, inside the bulb insertion opening forming walls, there are provided vertical ribs projecting toward the parallel disposed elastic hooks. That is, in the present bulb socket, between the mutually parallel disposed elastic hooks, there extends the vertical rib which is projected from the bulb insertion opening forming wall. Therefore, in the event the base of the bulb improperly aligned, the base will butt against the vertical rib, which makes it impossible for the base to enter between the elastic hooks and the adjacent wall.

According to another aspect of the invention, in a bulb socket as set forth above, the vertical ribs each projects up to a position intersecting a direction in which the elastic hooks are parallelly arranged, and includes an upper end potion which is so formed as to be situated above the leading end portions of the elastic hooks. With this structure, when the bulb is inserted into the bulb insertion opening, the base of the bulb is abutted against the vertical rib situated above the leading end portions of the elastic hooks. As a result, the base of the bulb is positively prevented from entering between the elastic hooks and the adjacent wall.

According to still another aspect of the invention, in a bulb socket as set forth above, each of the vertical ribs is formed in a flat plate shape which extends in a direction at right angles to the direction of the elastic hooks. Since the vertical rib is formed thin, when compared with a thick vertical rib, a defective product is less likely to occur when the bulb socket main body is formed.

According to still another aspect of the invention, in a bulb socket as set forth above, the upper end portion of each of the vertical ribs includes an introduction portion which slopes toward the inside of the bulb insertion opening. In particular, the introduction portion of the vertical rib upper end portion serves as a guide which guides the base of the bulb to the bulb insertion opening.

According to still another aspect of the invention, in a bulb socket as set forth above, at the positions that are situated inside the bulb insertion opening forming walls and correspond to the elastic hooks, there are provided hook contact ribs which are used to prevent the elastic hooks from being deformed excessively. Specifically, the elastic hooks are elastically deformed as the base of the bulb is inserted into the bulb insertion opening but, if they are deformed a given amount or more, then they are respectively butted against the hook contact ribs provided in the rear of the elastic hooks, which prevents the elastic hooks from being deformed any further.

DESCRIPTION OF THE PREFERRED EMBODIMENTS

Figure 1:
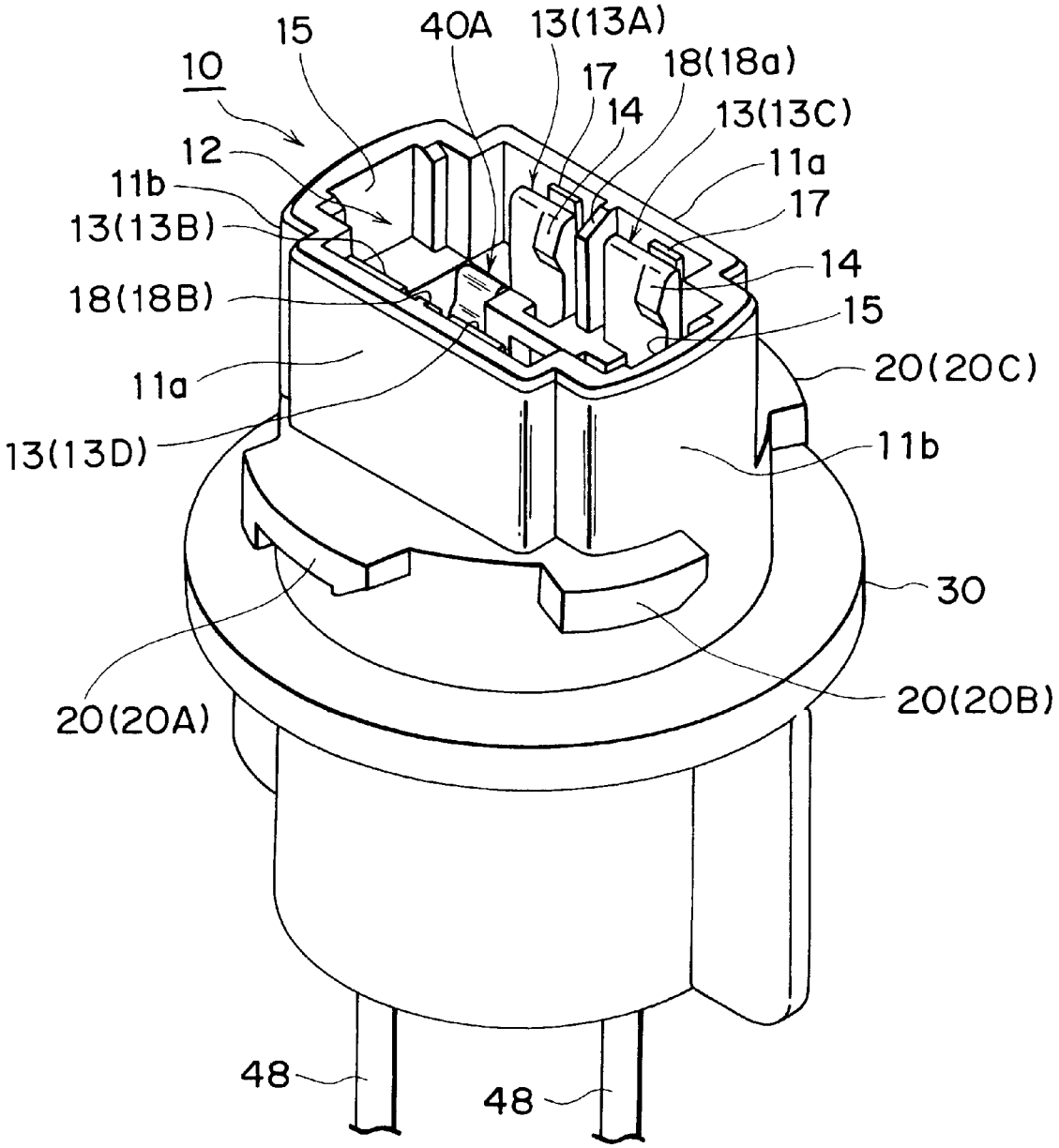
FIG. 1 is a perspective view of a socket for a wedge base bulb according to an embodiment of the invention.
Figure 2:
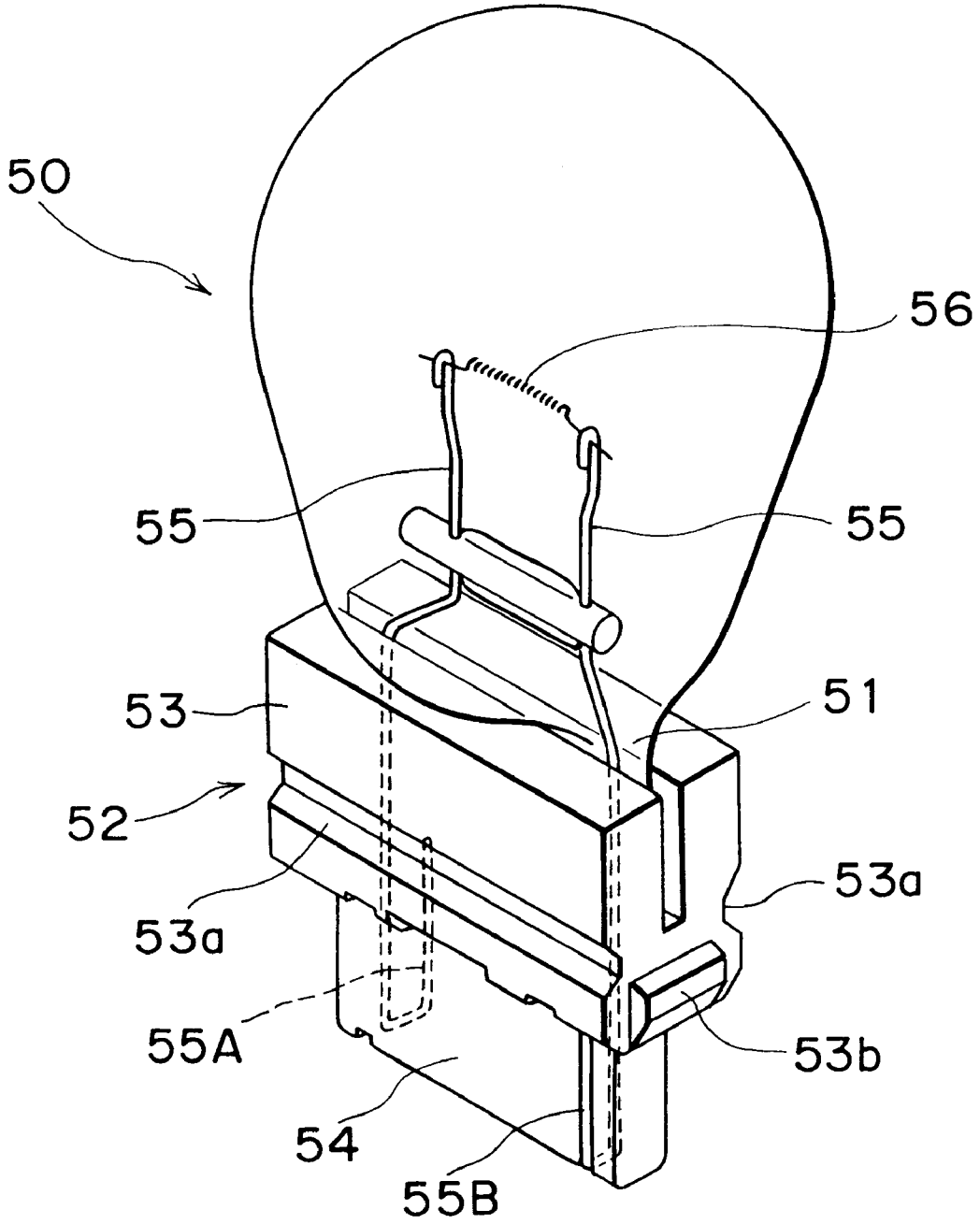
FIG. 2 is a perspective view of a wedge base bulb to be inserted into the present socket.

Next, description will be given below of a preferred embodiment of a bulb socket according to the invention with reference to the accompanying drawings.

FIGS. 1 to 12 illustrate a preferred embodiment of a bulb socket according to the invention.

In these figures. reference character 50 designates a wedge base bulb (which is hereinafter referred to as a bulb) in which a filament 56 with the two ends thereof supported by lead supports 55 is disposed within a glass spherical body. The bulb 50 includes a pinch-sealed flat bulb base end portion 51 through which the lead supports 55 are guided. Also, a base 52, which is formed of synthetic resin in a rectangular block shape, is formed integral with the bulb 50.

The bulb base 52 of the bulb 50 is composed of a bulb hold portion 53 which is formed in a rectangular block shape and is used to hold the bulb base end portion 51, and a flat lead wire hold portion 54 which is formed continuously with the bulb hold portion 53 and is used to hold lead wires (lead supports) 55A and 55B respectively guided through the bulb base end portion 51. Also, on the outside surfaces of the bulb hold portion 53, there are formed recessed grooves 53*a* which can be engaged with respective elastic hooks 13 (which will be discussed later) to thereby prevent the bulb hold portion 53 from being removed and, on the outside surface of the lead wire hold portion 54, there are exposed the lead wires (lead supports) 55A and 55B which are electrically connected with the filament 56 within the bulb 50.

Reference character 10 designates a bulb socket main body (which is hereinafter referred to as a socket main body) which is formed of synthetic resin in a cylindrical shape and disposed on a socket mounting member 60. The socket main body 10 includes on the front end side thereof a bulb insertion opening 12 into which the bulb 50 can be inserted. The bulb insertion opening 12 is formed in a rectangular shape which corresponds to the base 52 of the bulb 50. Within the bulb insertion opening 12, four elastic hooks 13 (13A, 13B, 13C, 13D) are provided for retaining the base 53 of the bulb 50 inserted into the bulb insertion opening 12. The hooks are arranged in pairs along two wide side surfaces 11*a* forming the bulb insertion opening 12 in such a manner that they are substantially opposed to each other. Each of the elastic hooks 13 includes a pawl 14 which is engageable with the recessed groove 53*a* formed in the base 52 of the bulb 50 to firmly retain the base 52.

Two vertical grooves 15 are respectively formed on the inside of short side surfaces 11*b* forming the bulb insertion opening 12. The two rectangular projections 53*b* provided on the base 52 of the bulb 50 are respectively slidingly engaged with the vertical grooves 15, so that the bulb 50 can be positioned in the vertical and horizontal directions of the bulb insertion opening 12.

Therefore, the base 52 of the bulb 50 can be pushed and smoothly inserted into the bulb insertion opening 12 from above, or taken out upwardly from the bulb insertion opening 12 against the elastic forces of the elastic hooks 13, to remove the base 52 from the bulb insertion opening 12.

Figure 10:
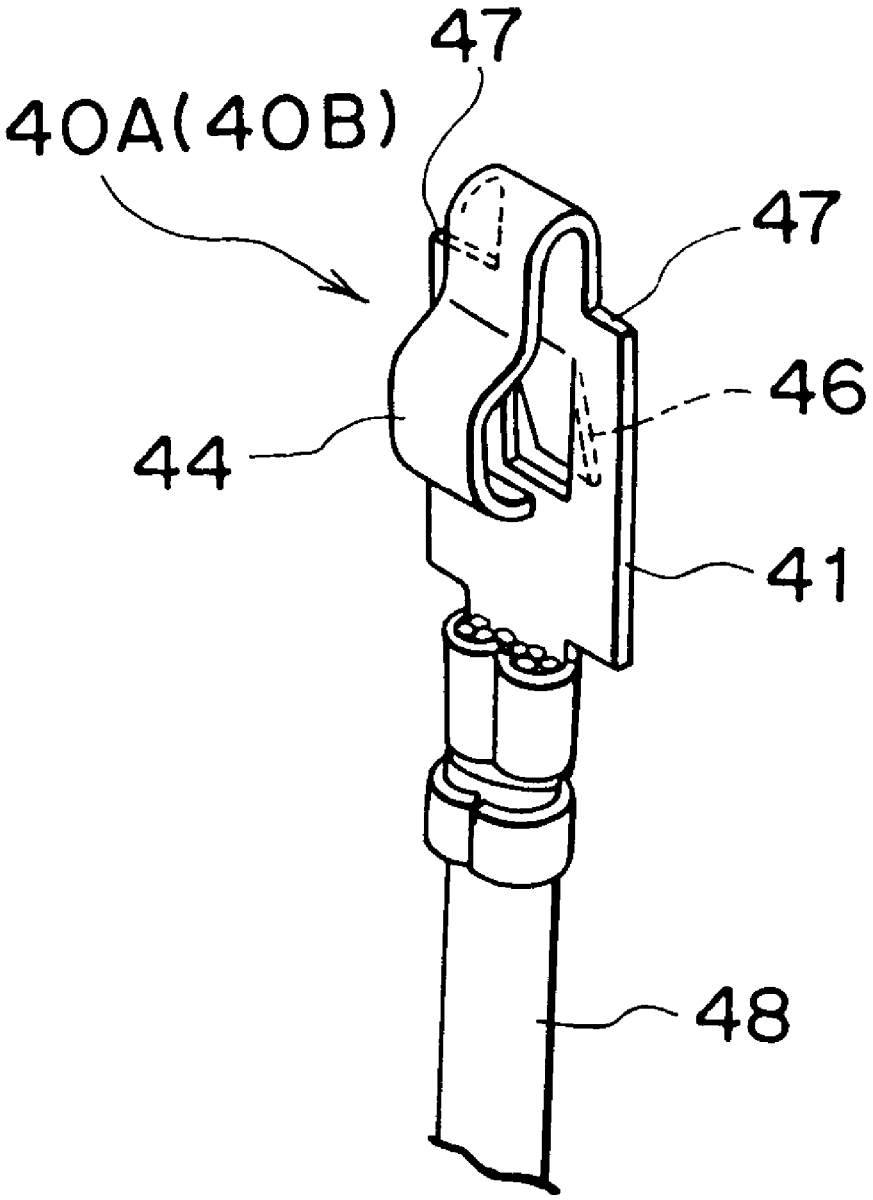
FIG. 10 is a perspective view of a terminal to be stored within the socket.
Figure 11:
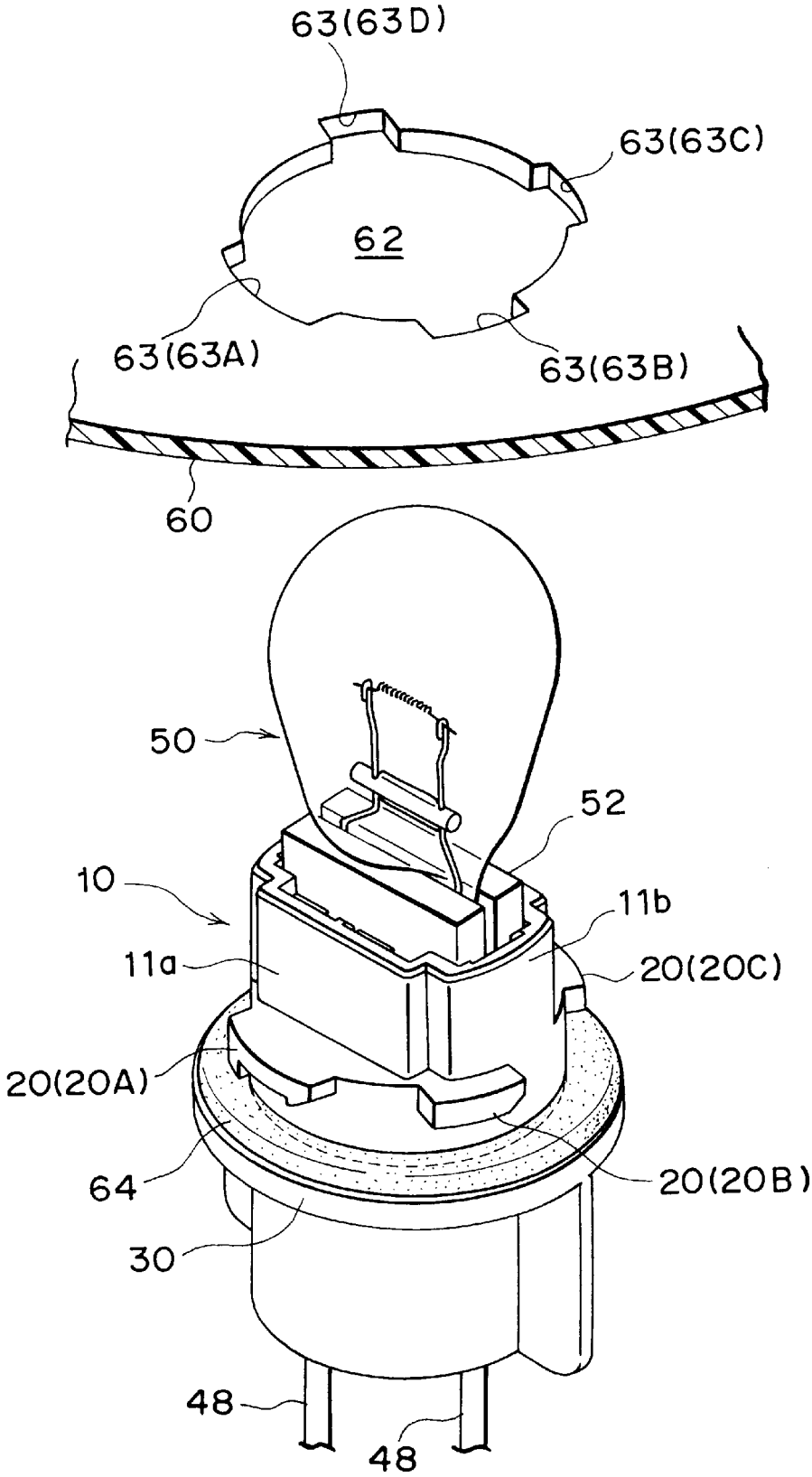
FIG. 11 is a perspective view a bulb socket and a socket mounting hole.
Figure 12:
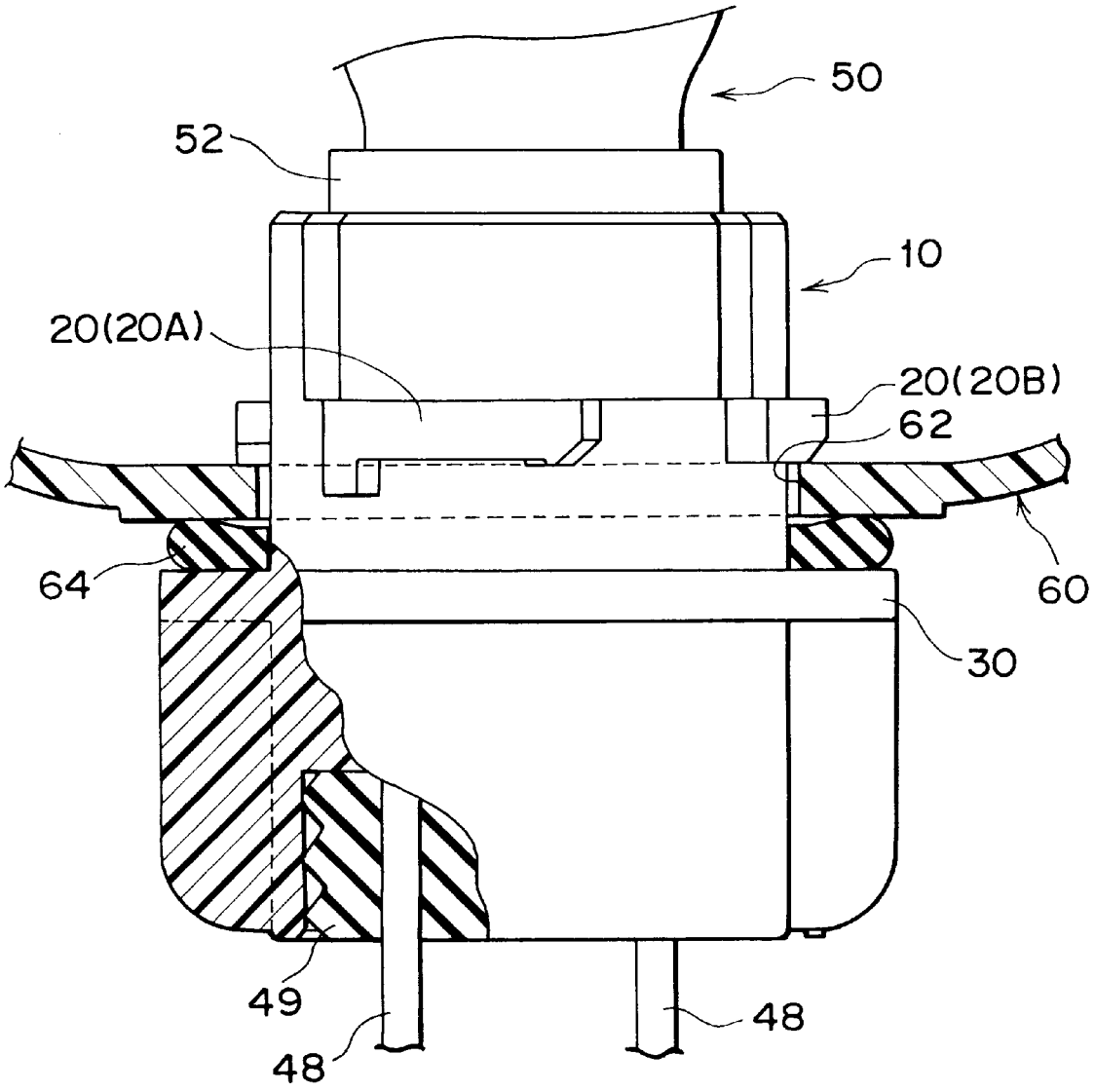
FIG. 12 is a section view of socket mounting hole peripheries in which a bulb socket with a bulb integrally inserted therein is mounted; and, FIG. 13 a perspective view of a bulb socket and a socket mounting hole according to the prior art.
Figure 13:
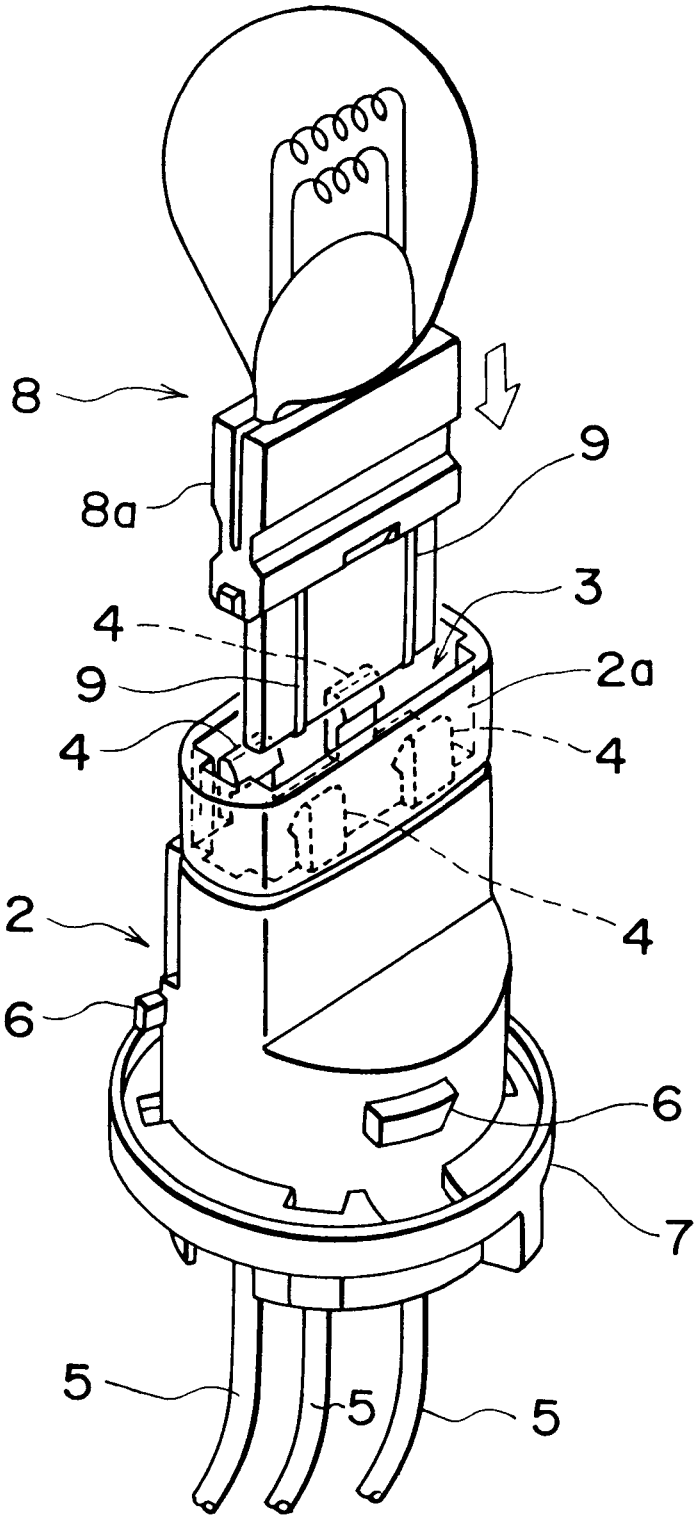

Also, within the bulb insertion opening 12, there are two contact terminals 40A (40B) shown in FIG. 10, so that the filament 56 of the bulb 50 inserted into the bulb insertion opening 12 can be energized electrically.

That is, the terminals 40A (40B) each comprises a plate-like base portion 41 which includes a turned-down, tongue-piece-shaped contact hold piece 44. Two electric wires 48 are respectively connected by crimping the wires to the lower end portion of the plate-like base portions 41 of the terminals 40A and 40B.

Also, the plate-like base portion 41 further includes a cut and raised rectangular securing piece 46. This securing piece 46 is engageable with a stepped portion 15*a* (see FIG. 7) of the securing groove 15 formed in the bulb insertion opening 12 for retaining the terminal 40A (40B) in place. The electric wires 48 connected to the terminals 40A and 40B are respectively passed through a rubber plug 49 and guided externally. The rubber plug 49 is inserted into the cylindrical rear end portion of the socket main body 10 for waterproofing purposes.

In a state where the bulb 50 (base 52) is inserted into the bulb insertion opening 12, the tongue-piece-shaped contact hold pieces 44 and 44 of the contact terminals 40A and 40B hold between them the lead wires 55A and 55B exposed on the outside surface of the lead wire hold portion 54, so that the contact terminals 40A and 40B are electrically connected with the lead wires 55A and 55B, respectively.

Also, the mutually opposed elastic hooks 13A and 13B (13C and 13D) are both formed in a plate-like shape, while the opposing pawls 14 thereof are laterally offset from each other in the plate width direction thereof. Due to this arrangement, a rotation energizing force is applied to the base 52 by means of base hold forces P (see FIGS. 3 and 8) caused by the four elastic hooks 13A, 13B, 13C and 13D, so that the contact terminals 40A and 40B can be kept in pressure contact with the lead wires 55A and 55B.

Figure 3:
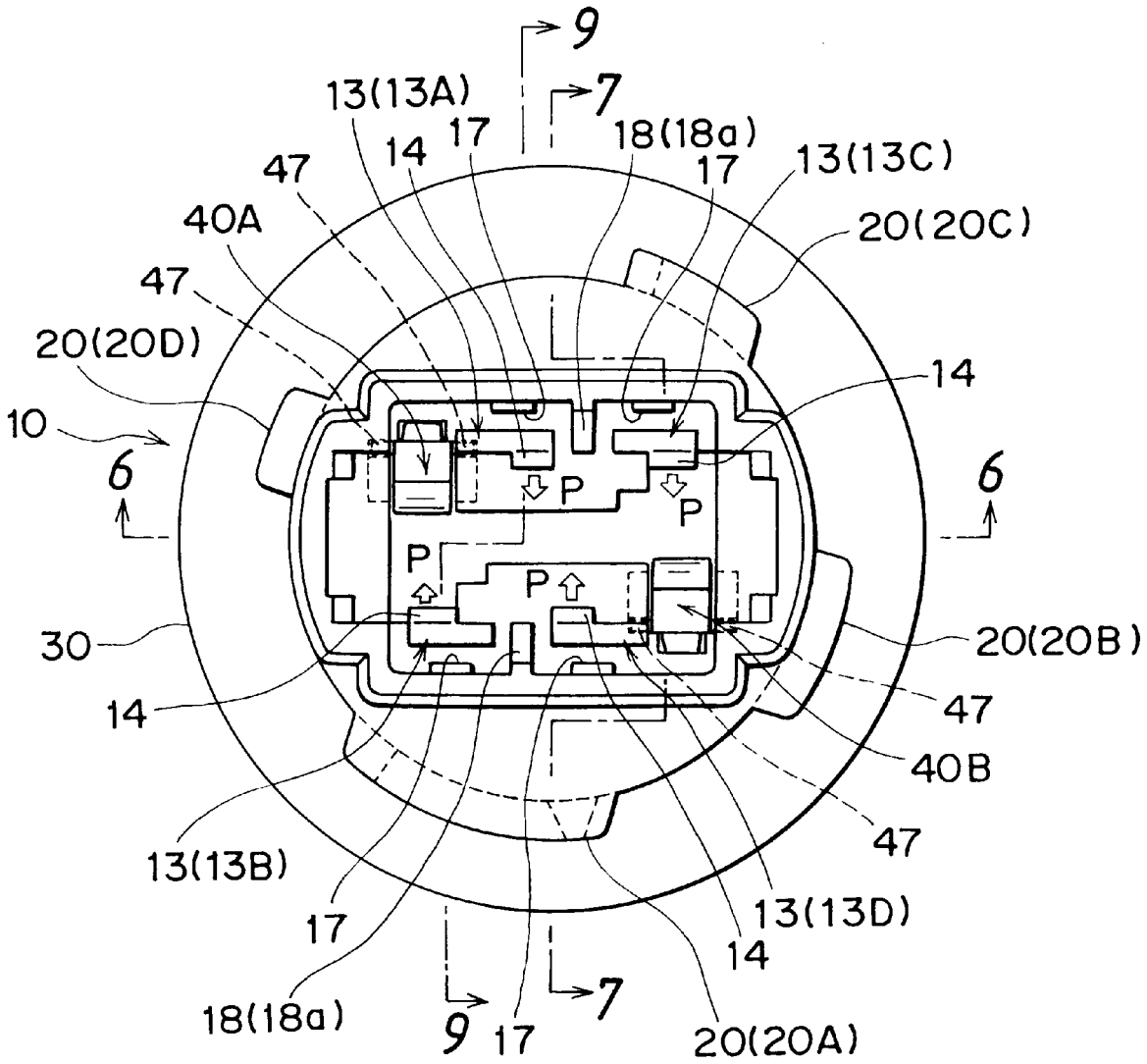
FIG. 3 is a plan view of the socket.
Figure 4:
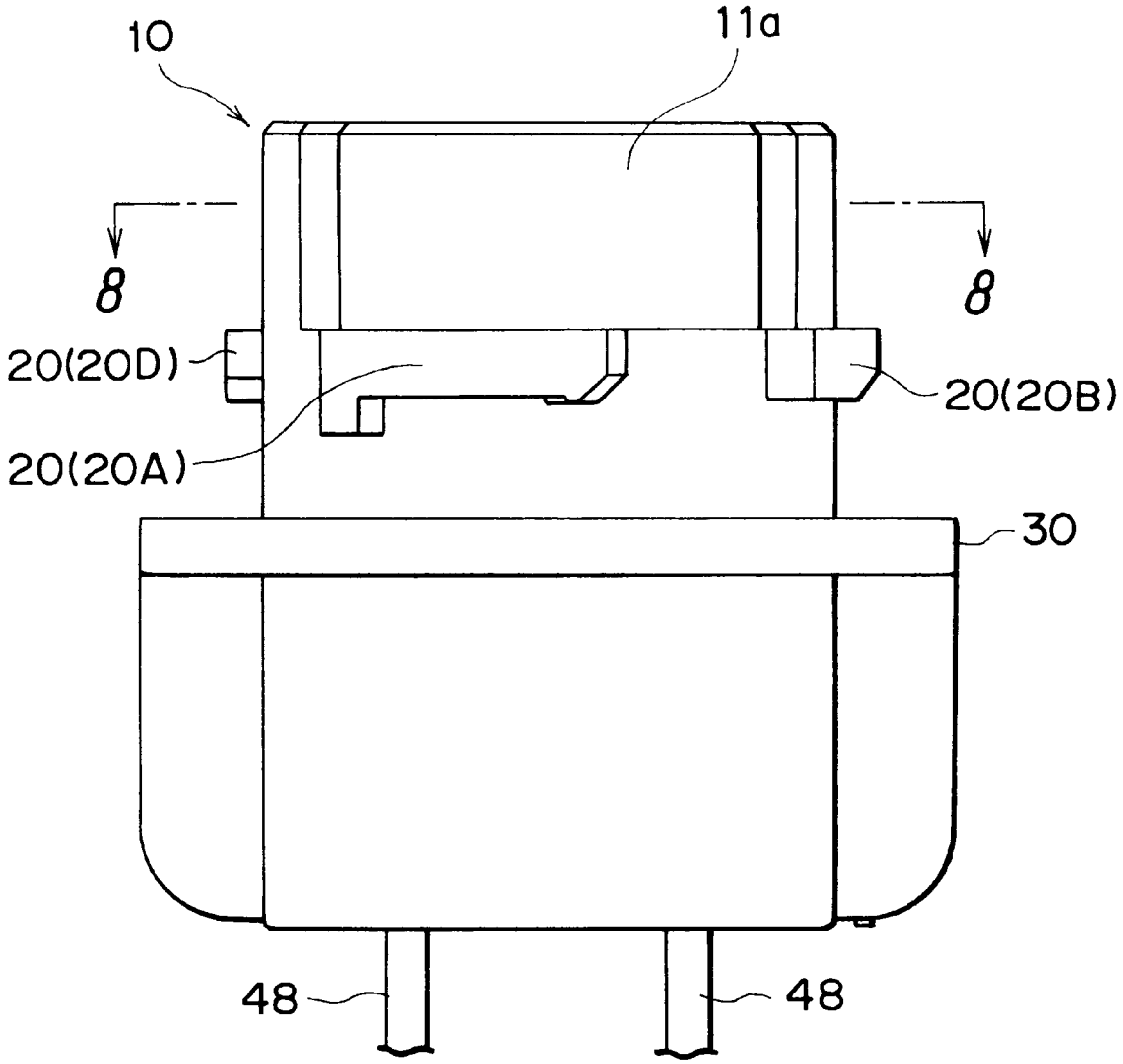
FIG. 4 is a front view of the socket.
Figure 5:
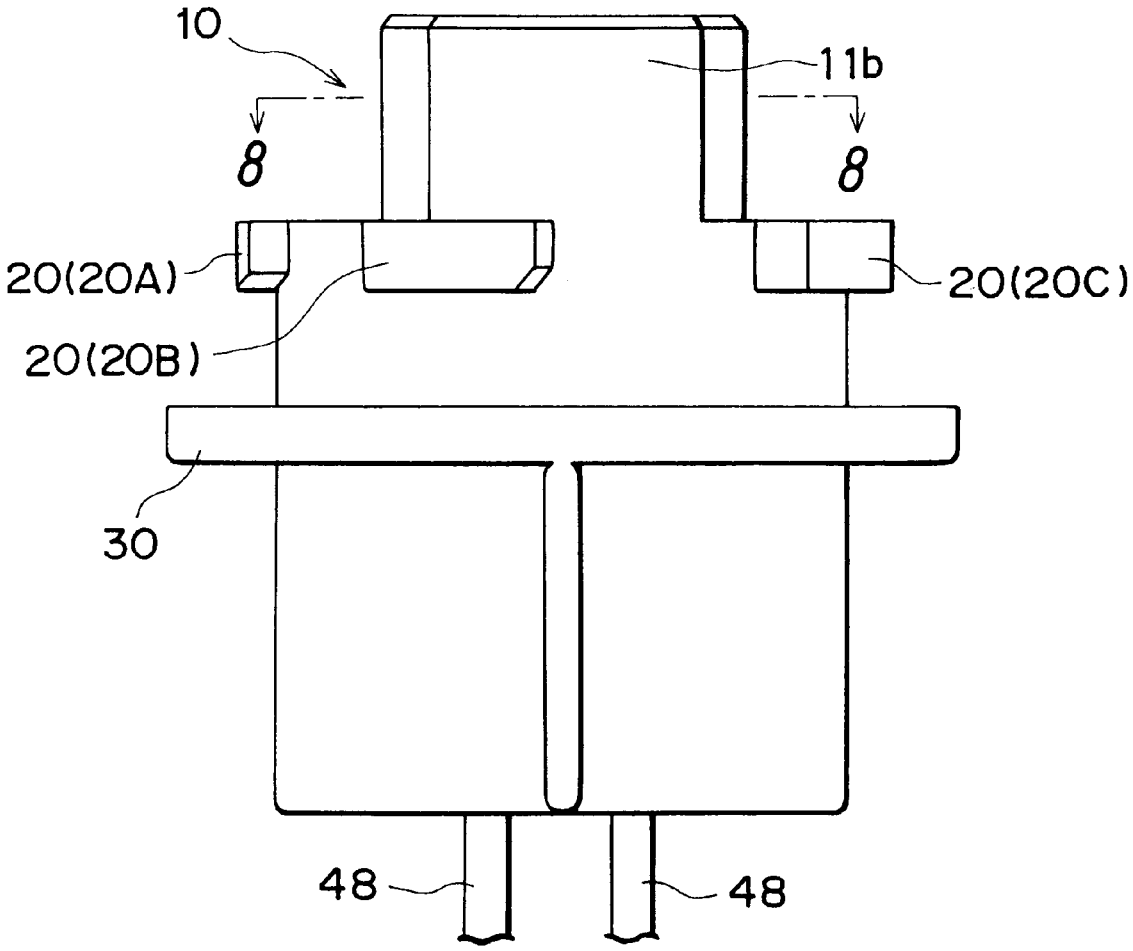
FIG. 5 is a right side view of the socket.
Figure 6:
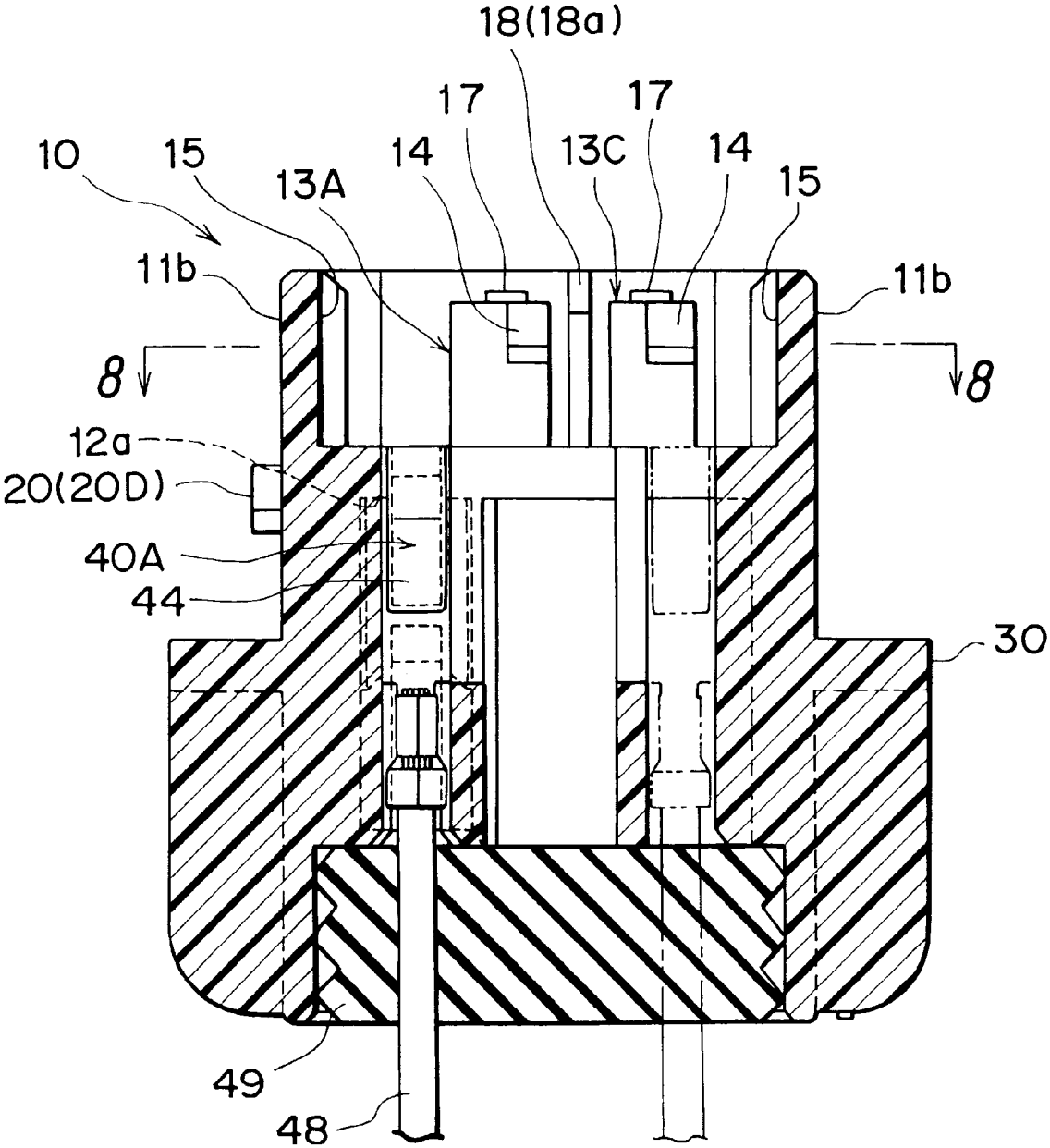
FIG. 6 is a longitudinal sectional view of the socket taken along line 6—6 in FIG. 3.
Figure 7:
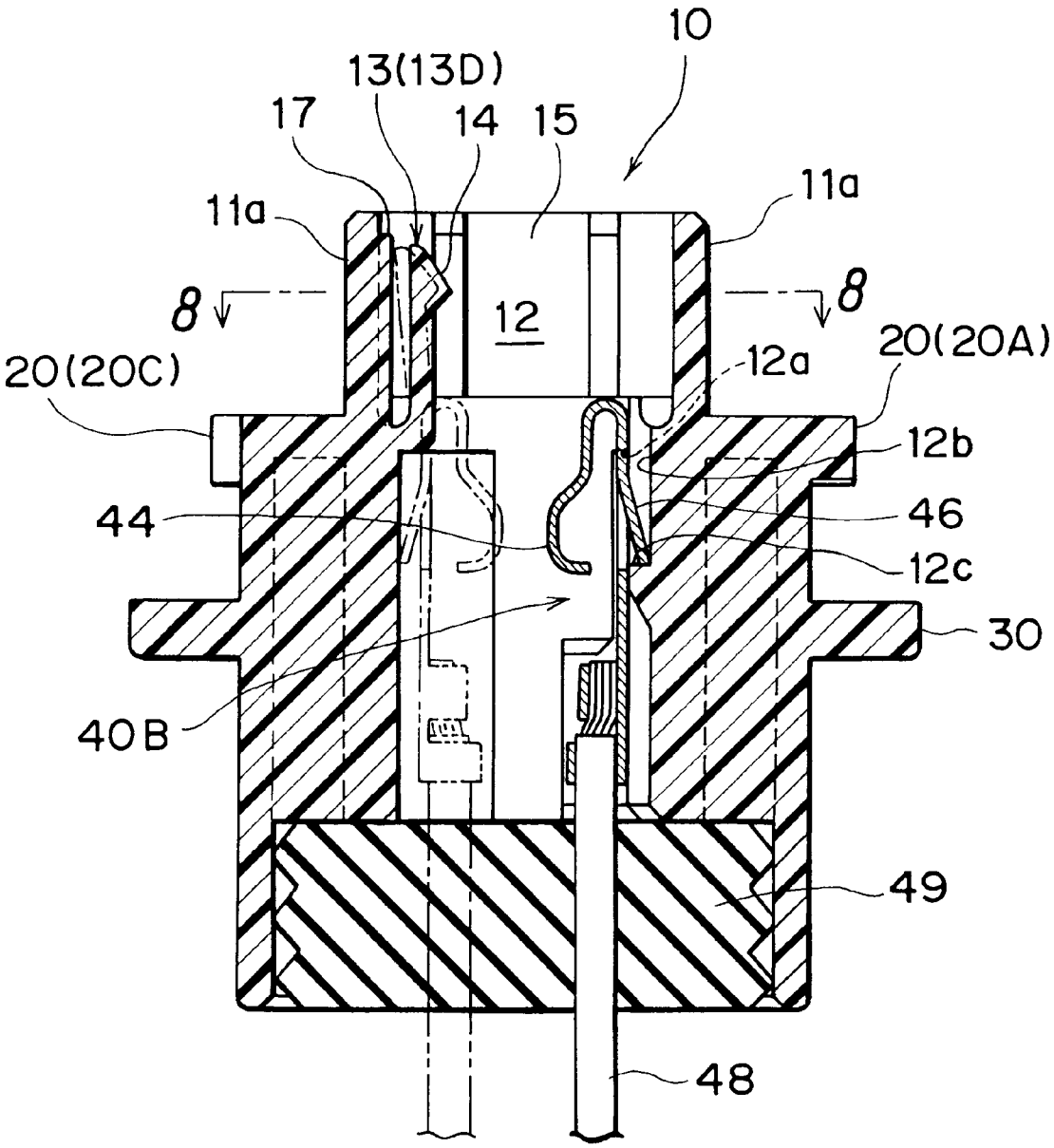
FIG. 7 is a longitudinal sectional view of the socket taken along line 7—7 in FIG. 3.
Figure 8:
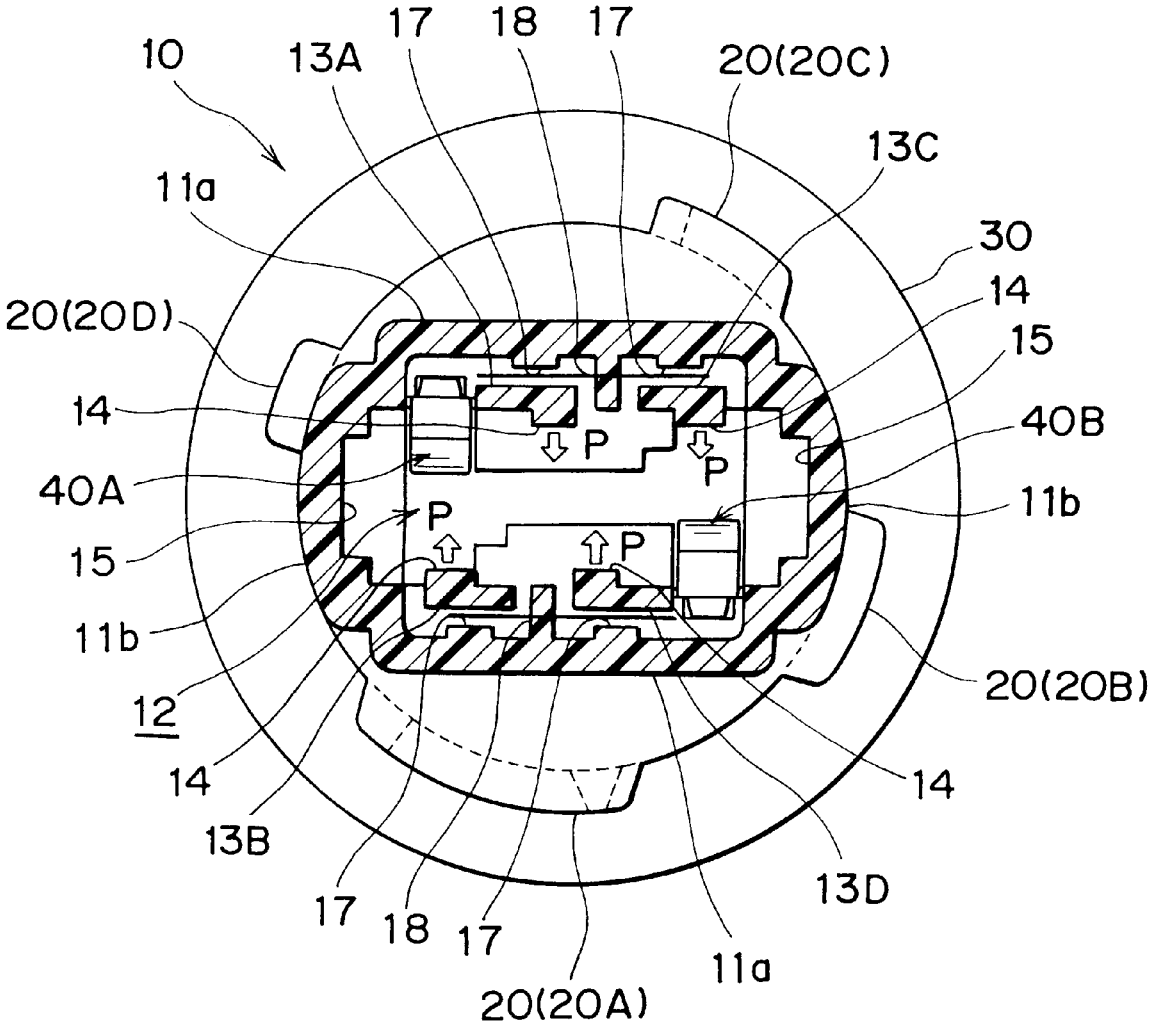
FIG. 8 is a horizontal sectional view of the socket taken along line 8—8 in FIGS. 4, 5, 6 and 7.
Figure 9:
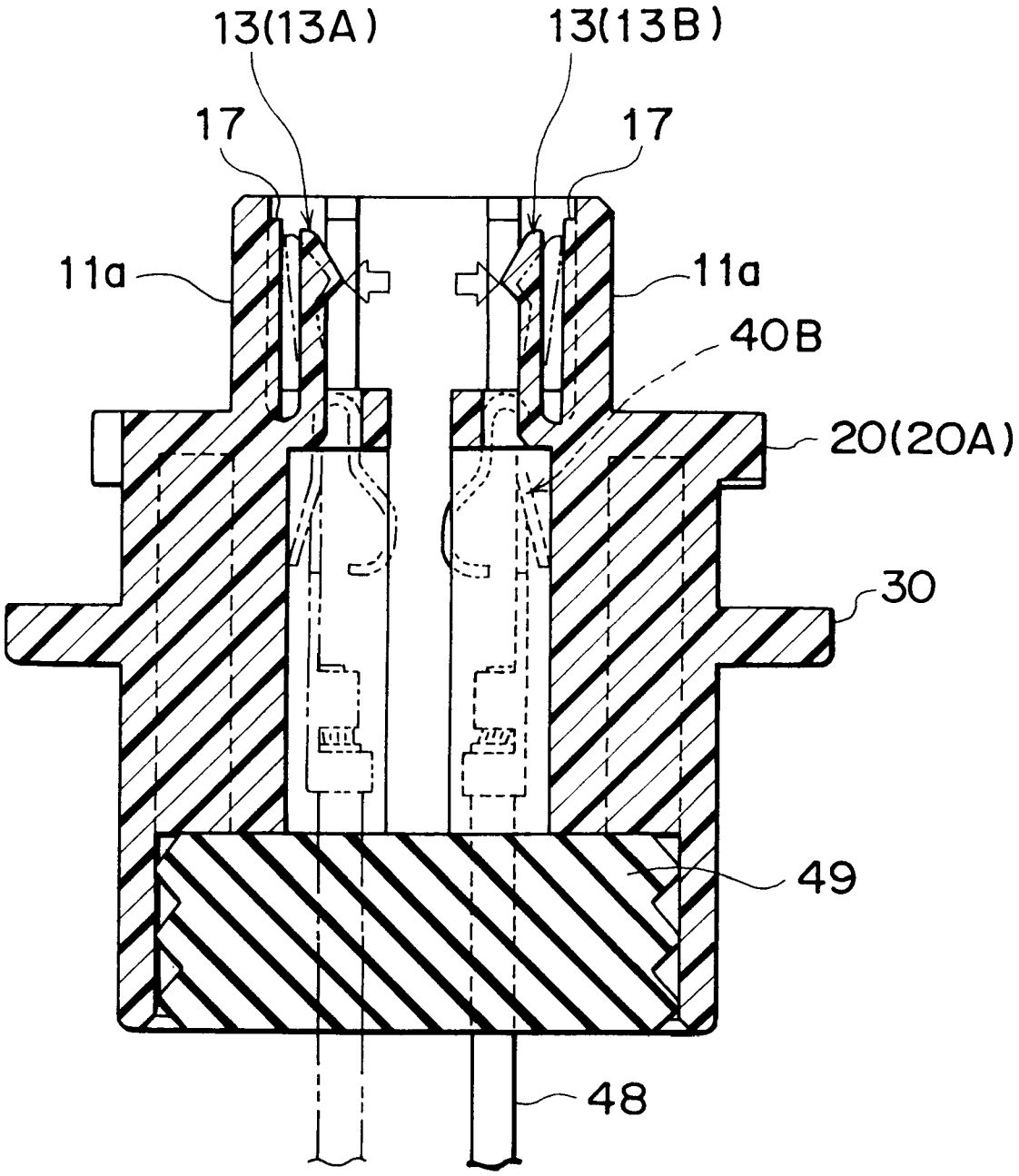
FIG. 9 is a section view to explain the operation of a hook contact rib.

In other words, in FIGS. 3 and 8, the elastic hooks 13A and 13C include the pawls 14 at their respective right ends in the plate width direction, whereas the elastic hooks 13B and 13D include the pawls 14 at their respective left ends in the plate width direction. As a result, the hold portions (base hold portions to be held by the pawls 14) of the mutually opposed elastic hooks 13A and 13B (13C and 13D) are positioned offset from each other in the base width direction. This results in the application of a right-handed rotation energizing force to the base 52 of the bulb 50 in FIGS. 3 and 8. Accordingly, the lead wires 55A and 55B can be held in pressure contact with the contact terminals 40A and 40B within the bulb insertion opening 12, thereby securing an electric connection between them.

Also, at positions that are situated inside of the wide side surface walls 11*a* and correspond to the elastic hooks 13, there are provided projecting portions 17 consisting of hook contact ribs which are used to prevent the elastic hooks 13 from being deformed excessively. That is, when the base 52 of the bulb 50 is inserted into the bulb insertion opening 12, the elastic hooks 13 are elastically deformed toward the side surface wall 11*a*, so that the pawls 14 of the hooks 13 can be engaged with the recessed grooves 53*a* of the base 52. When the base 52 is inserted into the bulb insertion opening 12 from above substantially straight with respect to the bulb insertion opening 12, the four elastic hooks 13 (13A to 13D) are all elastically deformed substantially uniformly, so that the base 52 can be inserted into the bulb insertion opening 12 smoothly. On the other hand, when the base 52 is inserted obliquely into the bulb insertion opening 12, some of the four elastic hooks 13 may experience a high bending stress. However, when the elastic hooks 13 experience an excessive bending stress so as to be deformed a given amount or more, then, as shown by the imaginary line in FIGS. 7 and 9, they are butted against their respective projecting portions 17. Therefore, the loads thereof can be thereby received by these projecting portions 17, with the result that the elastic hooks 13 can be prevented from being deformed any further.

As noted above, the elastic hooks 13 are disposed in parallel to each other along the side surface walls 11*a* and are sufficiently spaced apart from each other in order to be able to hold the flat base 52 of the bulb 50 in a manner to surely prevent the same from being loosened and removed. As shown in FIG. 3, there is a clearance between the respective side wall and elastic hooks 13A and 13C (13B and 13D). In order to prevent the base 52 of the bulb 50 from inadvertently being received in this clearance, there is arranged a plate-shaped vertical rib 18 which is formed like a vertical wall and extends outwardly from the side surface wall 11*a* of the main body 10. As a result, the base 52 of the bulb 50 cannot be inserted by mistake between the mutually adjoining elastic hooks 13A and 13C (13B and 13D) and the adjacent wall.

Each vertical rib 18 is formed in such a manner that it extends outwardly from the side surface wall 11*a* not only to the the horizontal surfaces of the elastic hooks 13A and 13C (13B and 13D) but also up to the opening edge portion (the leading end portion (top end) of the side surface wall 11*a*) of the bulb insertion opening 12 located slightly higher than the leading end portions top end of the elastic hooks 13A and 13C (13B and 13D). This completely eliminates the fear that the base 52 of the bulb 50 will be inserted between the elastic hooks 13A and 13C (13B and 13D) and the side walls 11*a*.

Further, the vertical rib 18 includes in the front end portion (upper end portion) thereof a sloping guide surface 18*a* serving as an introduction portion which slopes toward the inside of the bulb insertion opening 12. Therefore, the base 52 of the bulb 50 can be guided by the sloping guide surface 18*a* so as to be introduced between the mutually opposed elastic hooks 13A and 13B (13C and 13D), so that the bulb 50 can be inserted into the bulb insertion opening 12 smoothly. On the other hand, the socket main body 10 includes, at four equally spaced peripheral portions of the outside surface thereof, four securing projections 20 (20A, 20B, 20C, and 20D) which can be engaged in a bayonet-like manner with a socket mounting hole 62 (see FIG. 11) formed in a socket mounting member 60 to thereby prevent the socket main body 10 against removal. Here, reference character 63 (63A, 63B, 63C and 63D) identify notches which are engaged with the securing projections 20 (20A, 20B, 20C, and 20D). Also, at a position spaced a given distance in the axial direction of the socket main body 10 from the securing projections 20 (20A, 20B, 20C, and 20D), there is provided a horizontal flange 30 which cooperates together with the securing projections 20 for holding the peripheral edge portion of the socket mounting hole 62 through a seat packing 64, for waterproofing between the socket mounting hole 62 and socket main body 10.

That is, to mount the socket main body 10 into the socket mounting hole 62, the socket main body 10 may be pushed into the socket mounting hole 62 with the securing projections 20 (20A, 20B, 20C, and 20D) matched to the notches 63 (63A, 63B, 63C and 63D) of the socket mounting hole 62 and, at the same time, the thus pushed socket main body 10 may be rotated a given amount along the peripheral edge portion of the socket mounting hole 62, so that the peripheral edge portion of the socket mounting hole 62 can be held by and between the securing projections 20 and horizontal flange 30 through the seat packing 64.

As can be clearly understood from the foregoing description, in a bulb socket according to the invention, due to the fact that, when a bulb is inserted into a bulb insertion opening, there is eliminated a fear that the base of the bulb can be inserted between parallel disposed elastic hooks, so that the bulb can be inserted into the bulb socket smoothly. Also, when inserting the bulb, there is no possibility that the base of the bulb will be caught by the elastic hooks, to prevent the elastic hooks from breaking.

Also, according to the invention, when the bulb is inserted into the bulb insertion opening, the base of the bulb is prevented from interfering with the leading end portions of the elastic hooks, so that the bulb can be inserted into the bulb insertion opening easily and smoothly.

Further, according to the invention, since the vertical rib is formed thin, when compared with a case in which the vertical rib is formed thick, the bulb socket is lighter in weight, low in material costs and less likely to be defectively formed, thereby lowering the rate of occurrence of poor products.

Still further, according to the invention, because the base of the bulb can be guided along the introduction portion of the vertical rib upper end portion to the proper position of the bulb insertion opening, the bulb can be consistently inserted into the bulb socket simply and easily.

Yet further, according to the invention, since the hook contact ribs respectively provided on the inside of the bulb insertion opening forming walls prevent an excessive stress from being applied to the elastic hooks, the durability of the elastic hooks can be secured.

What is claimed is:

1. A bulb socket comprising:

a socket main body including a bulb insertion opening opened forwardly for insertion of a wedge base bulb thereinto;

a socket mounting member having an inner peripheral edge portion in which said socket main body is inserted;

a plurality of securing projections provided on a peripheral surface of said socket main body, said projections being engageable with a socket mounting hole formed in said socket mounting member to thereby prevent the socket main body against removal from said socket mounting member; and a flange cooperable with said securing projections for engaging the inner peripheral edge portion of the socket mounting member;

wherein a plurality of elastic hooks are provided in said bulb insertion opening for retaining a base of said bulb inserted into said bulb insertion opening to thereby restrain said bulb against removal from said socket main body, said elastic hooks being disposed on side walls adjacent each other and opposite each other, and respectively arranged parallel to said side walls defining said bulb insertion opening, with respective gaps formed in each said side walls between said adjacent elastic hooks; and wherein vertical ribs each projects outwardly from said side walls to a position intersecting a direction in which said elastic hooks are disposed parallel to said side walls, and each said vertical ribs includes an upper end portion which is disposed higher than leading end portions of said elastic hooks at said bulb insertion opening; and wherein said vertical ribs are respectively provided in said gaps to prevent said base of said bulb from improper insertion in clearances formed between said side walls and said elastic hooks.

2. A bulb socket as set forth in claim 1, wherein said vertical ribs each is formed in a flat plate shape which extends outwardly from said side walls in a direction at right angles to said elastic hooks.

3. A bulb socket as set forth in claim 2, wherein said upper end portion of each of said vertical ribs includes an introduction portion sloping toward the inside of said bulb insertion opening.

* * * * *